US007198430B2

(12) United States Patent
Nakakuma

(10) Patent No.: US 7,198,430 B2
(45) Date of Patent: Apr. 3, 2007

(54) REFORMATION OF SOFT SOIL AND SYSTEM THEREFOR

(75) Inventor: Kazuyoshi Nakakuma, Saitama (JP)

(73) Assignee: Maruyama Kougyo Kabushikikaisha, Saitama (JP)

( * ) Notice: Subject to any disclaimer, the term of this patent is extended or adjusted under 35 U.S.C. 154(b) by 0 days.

(21) Appl. No.: 10/451,309

(22) PCT Filed: Oct. 31, 2002

(86) PCT No.: PCT/JP02/11409

§ 371 (c)(1),
(2), (4) Date: Nov. 5, 2004

(87) PCT Pub. No.: WO2004/040068

PCT Pub. Date: May 13, 2004

(65) Prior Publication Data

US 2005/0063790 A1 Mar. 24, 2005

(51) Int. Cl.
*E02D 3/10* (2006.01)
*E02D 3/00* (2006.01)

(52) U.S. Cl. ..... 405/36; 405/258.1

(58) Field of Classification Search ..... 405/36, 405/37, 41, 50, 270, 258.1, 302.4; 210/170, 210/747

See application file for complete search history.

(56) References Cited

U.S. PATENT DOCUMENTS

| | | | | | |
|---|---|---|---|---|---|
| 2,615,307 | A | * | 10/1952 | Kjellman | 405/50 |
| 3,386,251 | A | * | 6/1968 | Casagrande et al. | 405/302.4 |
| 4,462,184 | A | * | 7/1984 | Cunningham | 47/58.1 R |
| 4,704,047 | A | * | 11/1987 | Oldfelt et al. | 405/37 |
| 4,881,846 | A | * | 11/1989 | Burkstaller | 405/37 |
| 5,350,251 | A | * | 9/1994 | Daniel | 405/37 |
| 5,800,090 | A | * | 9/1998 | Goughnour | 405/302.4 |
| 5,944,444 | A | * | 8/1999 | Motz et al. | 405/37 |
| 6,254,308 | B1 | * | 7/2001 | Cognon | 405/43 |

FOREIGN PATENT DOCUMENTS

| | | | | |
|---|---|---|---|---|
| EP | 329500 | * | 8/1989 | 405/50 |
| JP | 04203014 | * | 7/1992 | |
| JP | 09125355 | * | 5/1997 | |
| JP | 10-325136 A | | 12/1998 | |
| JP | 10325136 | * | 12/1998 | |
| JP | 2000-144707 A | | 5/2000 | |
| JP | 2002-210062 A | | 8/2000 | |
| JP | 2000328550 | * | 11/2000 | |
| JP | 2001-311136 A | | 11/2001 | |
| JP | 2001311136 | * | 11/2001 | |
| JP | 2002-146768 A | | 5/2002 | |
| JP | 2003160927 | * | 6/2005 | |

* cited by examiner

*Primary Examiner*—John Kreck
(74) *Attorney, Agent, or Firm*—Adams Evans P.A.

(57) ABSTRACT

A system and a method for draining soft soil A bordered with soil B are disclosed. The system includes an airtight sheet 10 which covers the soft soil A to assist in vacuuming the soft soil A. The system further includes water gathering pipes 13 and a water drain tank 16 to receive water from the water gathering pipes 13. The water gathering pipes 13 and the water drain tank 16 provide water passages and air passages separately so as to expedite the drainage operation.

20 Claims, 11 Drawing Sheets

REFORMATION OF SOFT SOIL AND SYSTEM THEREFOR

This application is a national stage application of International Application No. PCT/JP02/11409, filed Oct. 31, 2002, according to Chapter I of the Patent Cooperation Treaty.

BACKGROUND OF THE INVENTION

1. Field of the Invention

This invention generally relates to a method and a system for reforming soft soil such as muddy soil or swampy soil by draining underground water therefrom. More particularly, this invention relates to a method and a system for efficiently hardening soft soil by adequately separating air passages and water passages in the drainage routes.

2. Background Art

JP Patent Application Laid-Open No. 11-131465 teaches use of vertical drains which are laid vertically in target soft soil to vacuum the soil and drain underground water.

FIG. 11 shows a conventional drain system comprised of vertical drains 1, horizontal drains 2 laid in contact with the vertical drains 1, water gathering pipes 3 laid in contact with the horizontal drains 2, and airtight sheet means 6 which covers target soft soil A after the vertical drains 1, the horizontal drains 2 and the water gathering pipes 3 have been installed in place. The drain system is further comprised of vacuum tank means 4 placed in connection with the water gathering pipes 3 and vacuum pump means 5 placed in connection with the vacuum tank means 4.

In use of the conventional drain system shown in FIG. 11, the vacuum pump means 5 vacuums the vacuum tank means 4. When a check valve (not shown) provided on the vacuum tank means 4 is opened, the water gathering pipes 3 are vacuumed. The vacuuming effect propagates to the horizontal drains 2 and the vertical drains 1 which are in connection with the horizontal drains 2 and reduces their respective inner pressures to below 0.4 atm. The target soft soil A is gradually evacuated from around the vertical drains 1 where air is drawn into the vertical drains 1. The evacuated regions gradually spread throughout the soft soil A.

Spread of the evacuated regions in the soft soil A directs underground water and underground air towards the vertical drains 1 and the water and air drawn into the vertical drains 1 travel up through the vertical drains 1. The water and air are sucked into the horizontal drains 2 and then into the water gathering pipes 3. The continued drainage of the target soft soil A further spreads the evacuated regions.

The whole of the target soft soil A will eventually be vacuumed to around 0.4 atm, and underground water and air are eventually drained out of the soft soil A, leading to compaction of the soft soil A to a harder and stabler soil state.

It is to be noted that in the conventional system the vacuuming routes and water drain routes are common. Therefore, sucked air and water flow together all through the common routes comprised of the vertical drains 1, the horizontal drains 2, the water gathering pipes 3, the vacuum tank means 4 and the vacuum pump means 5.

Initially, underground water and air flow into the water gathering pipes 3 in large quantities from the horizontal drains 2, which stuffs the water gathering pipes 3 and therefore impedes subsequent vacuuming of the target soft soil A as will be readily understood by those skilled in the art.

In addition, as the compaction of the soft soil A progresses and the soft soil A sinks, the vertical distance from the underground water level to the vacuum pump means 5 widens, and efficiency of drainage degrades as will be readily understood by those with ordinary skills.

SUMMERY OF THE INVENTION

Therefore, it is an object of the present invention to provide an improved drainage method and an improved drain system for reforming or hardening soft ground or soil, wherein the drain system provides separated water passages and air passages.

The drainage method of the present invention which uses a drain system of the invention provides an improved efficiency in draining underground water from soft soil and hardening the soft soil in a relatively short period of time by adequately separating the water passages and the air passages of the system.

The drain system of the present invention provides an improved efficiency in draining underground water from soft soil and hardening the soft soil in a relatively short period of time by adequately separating its water passages and air passages.

BEST MODE OF THE INVENTION

Figure 1:
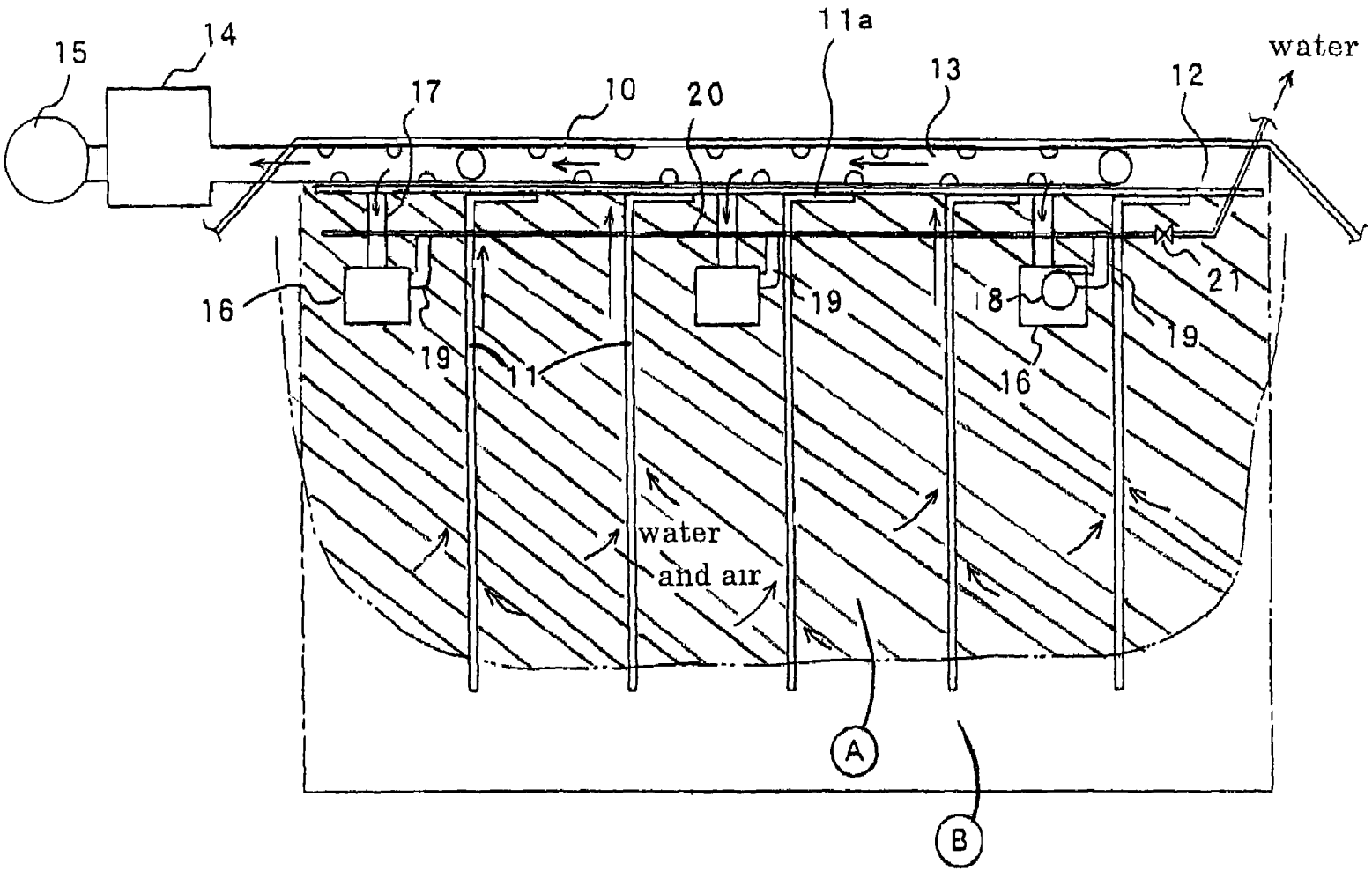
FIG. 1 is a schematic diagram showing a drain system of the present invention.

The present invention is described hereunder using the drawings which accompany the specification. In FIG. 1 is shown a drain system according to an embodiment of the present invention which efficiently drains and hardens target soft soil A surrounded by soil B.

The vacuuming and drainage routes include vertical drains 11, horizontal drains 12 which are laid in contact with the vertical drains 11, water gathering pipes 13 which are laid in contact with the horizontal drains 12, vacuum tank means 14 placed in connection with the horizontal drains 12, and vacuum pump means 15 placed in connection with the vacuum tank means 14.

The vertical drain 11 comprises an elongated net body made of a synthetic resin material and a substantially equally elongated nonwoven fabric body which is folded in half along its longitudinal center line and longitudinally sandwiches the net body in a sheath-blade relationship. The horizontal drain 12 also comprises an elongated net body made of a synthetic resin material and a substantially equally elongated nonwoven fabric body which is folded in half along its center line and longitudinally sandwiches the net body in a sheath-blade relationship.

The vertical drain 11 and the horizontal drain 12 may be of any elongated materials as long as they can provide both water and air passages without clogging even when bent or deformed with ground pressure.

The vertical drains 11 are vertically installed at predetermined intervals, length and breadth, in the target soft soil A with their top portions bent and laid on the surface of the soft soil A.

The horizontal drains 12 are laid on the surface over the target soft soil A in contact with the bent top portions of the vertical drains 11.

Air and water together enter the vertical drain 11 and the horizontal drain 12 through the nonwoven fabric bodies and flow through the net bodies and the nonwoven fabric bodies.

A plurality of water gathering pipes 13 are placed horizontally in fluid association with the horizontal drains 12. The water gathering pipes 13 have many through holes in the cylindrical walls to draw in air and water from the horizontal drains 12. The water gathering pipes 13 are connected to the vacuum tank means 14 which is connected to the vacuum pump means 15 installed outside the target soft soil A or in the soil B. Any type of vacuum pump means 15 may be used. Watertight type pump means 15 may be advantageously used.

The vertical drains 11, the horizontal drains 12 and the water gathering pipes 13 are covered with airtight sheet means 10 to provide effectuate evacuation of the soft soil A. Any type of airtight sheet means 10 may be used. A synthetic film laminated fibrous sheet may be advantageously used.

The drain system of FIG. 1 includes water drain tank means 16 installed in connection with the water gathering pipes 13 via water/air separator means 17. The separator means 17 gravitationally separates water from air and lets only water drop into the drain tank means 16.

The accumulated water in the drain tank means 16 is pumped out with water drain pump means 18 and drained out of the target soil A through connection pipes 19 and water drain pipes 20. Any type and size of drain tank means 16 may be used. Also, any type of drain pump means 18 may be used.

Water meter means may be additionally provided in the drain tank means 16 to control the water levels. The water drain tank means 16 may alternatively be provided with automatic drain control means to control the drain pump means 18 so as to provide controlled drainage.

The connection pipes 19 and the water drain pipes 20 should be installed below the water gathering pipes 13 to utilize the work of gravity. The sizes of the connection pipes 19 or the water drain pipes 20 may be decided according to requirements.

In this embodiment, the connection pipes 19 and the water drain pipes 20 are provided with check valves 21 to prevent counter water flows.

The drain system of this embodiment provides separate air and water expelling routes or passages. Water is accumulated in the water drain tank means 16 and expelled through the connection pipes 19 and the water drain pipes 20. Air and the water which has not entered the water drain tank means 16 are together sent into the vacuum tank means 14. The air and the water in the vacuum tank means 14 are expelled out of the vacuum tank means 14 with the vacuum pump means 15.

Figure 2:
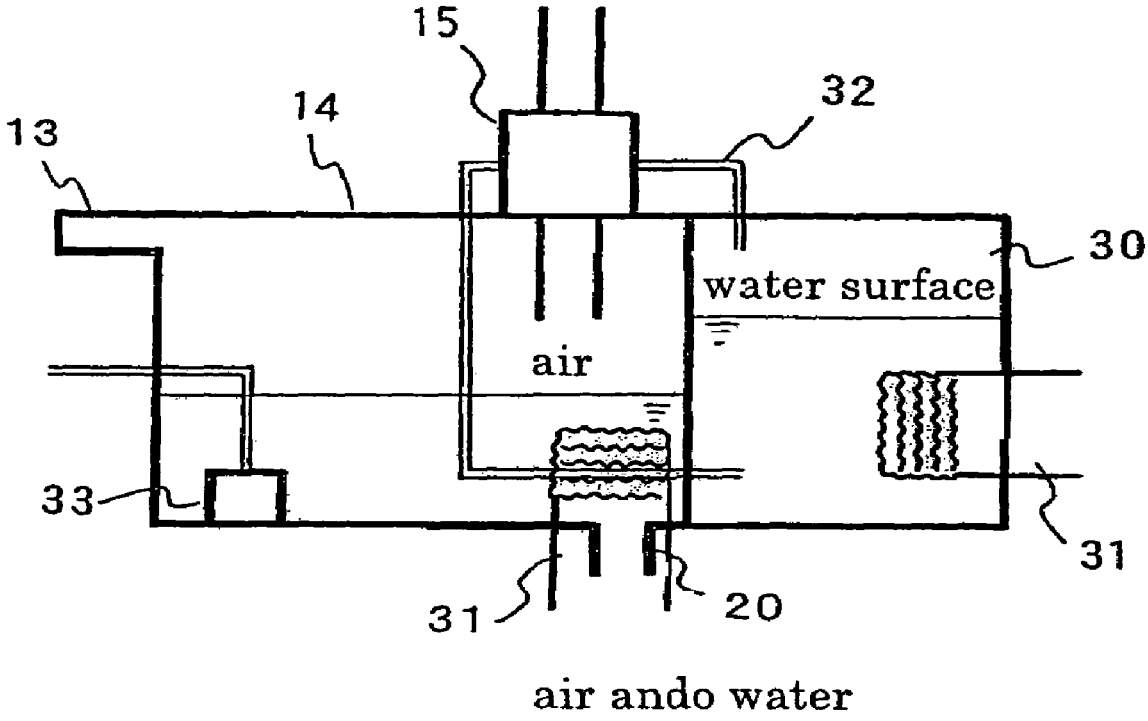
FIG. 2 is a schematic diagram showing a vacuum tank of the present invention.

FIG. 2 shows a watertight type vacuum pump 30 used as part of the vacuum pump means 14 which includes a water circulation tank 30. The water tight vacuum pump 30 requires cooling water. According to the present invention, the underground water supplied into the vacuum pump means 14 is limited. As a compensation, the water circulation tank 30 supplies water to the vacuum pump means 14 through a circulation pipe 32. The circulation water may be cooled with cooling means 31.

The water drain pipe 20 is connected to the vacuum tank means 14. If underground water supplied through the water drain pipe 20 is cool enough, the cooling means 31 is not required.

Figure 3:
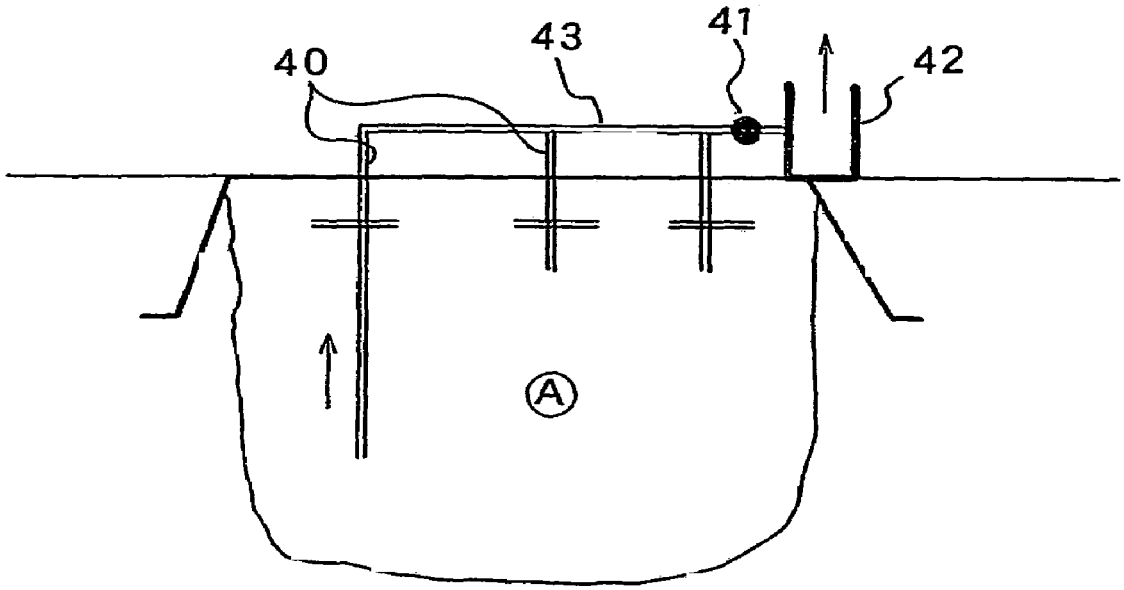
FIG. 3 is a schematic diagram partially showing an assistant system of the present invention.

FIG. 3 shows an assistant system of the present invention, which sends air continuously or periodically into the soft soil A and/or the soil B to promote drainage operation after the soft soil A has been sufficiently vacuumed and drained to a considerable extent. This system includes a plurality of vertical drain pipes 40 which are connected with water gathering pipes 43, air blower means 41 and air compression control means 42.

In an embodiment, this system blows air into the soft soil A in a controlled manner so that the pressure in the soft soil A does not exceed a desired pressure level, e.g. 0.4 atm.

It was found that the air blown into the target soft soil A helps press down the underground water level and promotes plasticity and unsaturation of the soft soil A, effectively improving water drainage from the soft soil A. Alternatively, the vertical pipes 40 may be used only for air extraction from the soft soil A.

Figure 4:
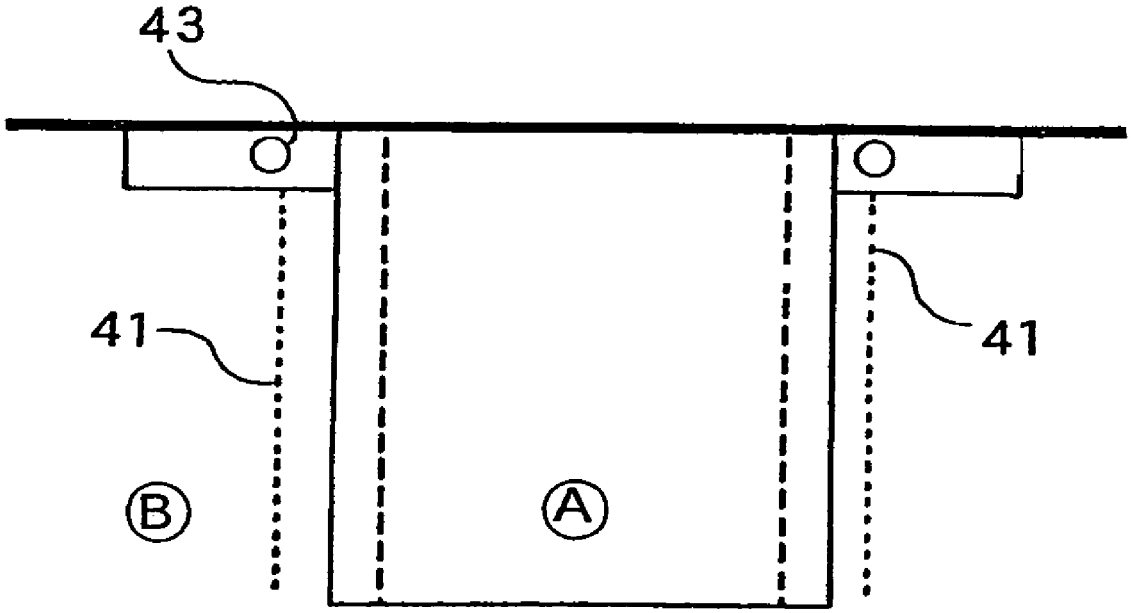
FIG. 4 is a schematic diagram partially showing another assistant system of the present invention.

FIG. 4 introduces another assistant system of the present invention. In an embodiment using the system shown in FIG. 4, a plurality of vertical drain pipes 41 are vertically installed in the peripheral soil B (preferably within a peripheral belt zone of several meters wide around the soft soil A) at 0.3 m–1 m intervals in fluid association with water gathering pipes 43.

The underground water in the peripheral soil B is drawn into the vertical drain pipes 41 together with air, and the soil B gradually dries, which helps in hardening the surface soil layers of the soil B, promoting separation of the peripheral soil B from the soil A, which by turn expedites sinking of the soft soil A independently from the soil B.

Figure 5:
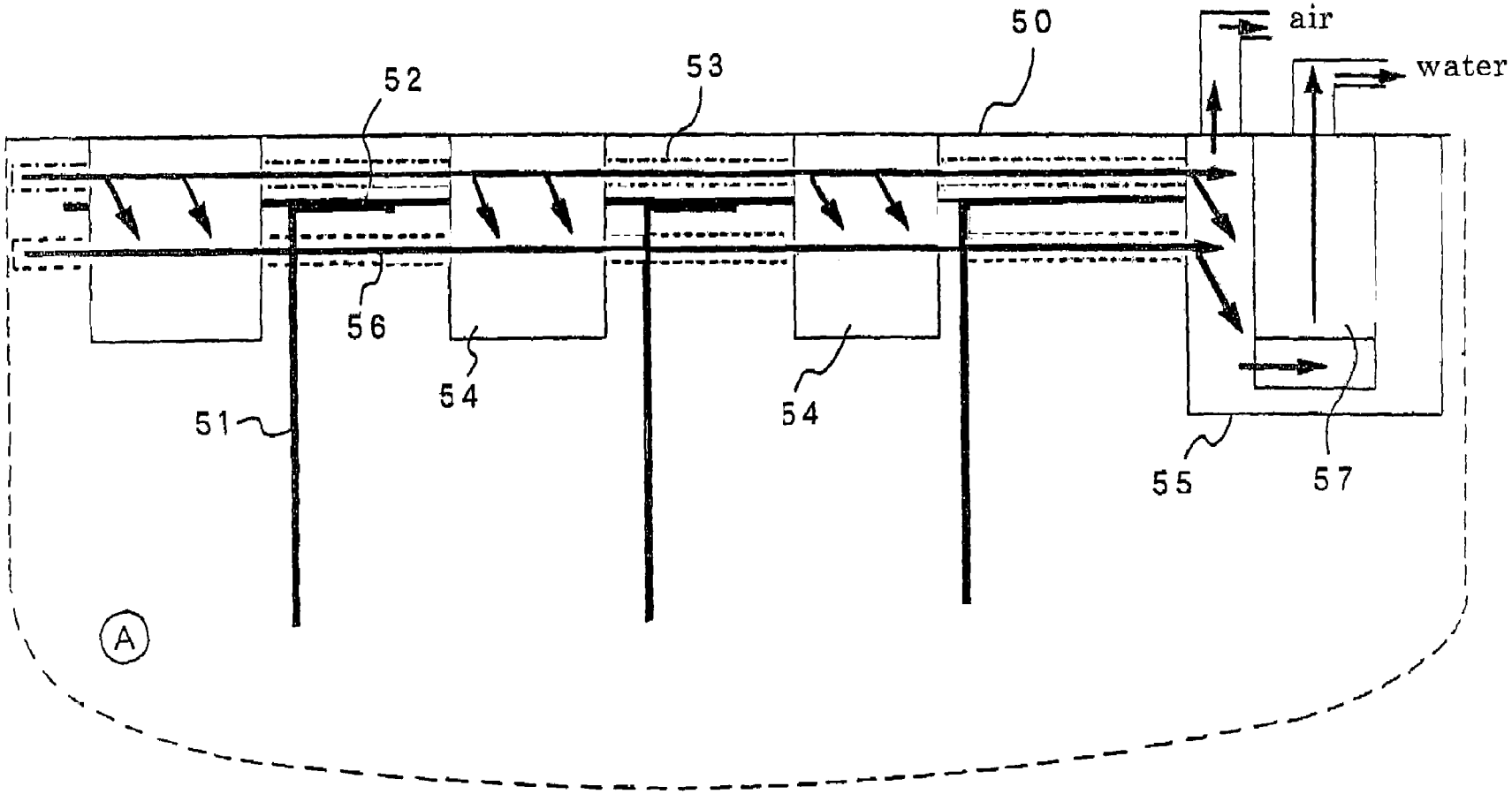
FIG. 5 is a schematic diagram showing another drain system of the present invention.

FIG. 5 introduces another drain system of the present invention. The system shown in FIG. 5 includes first water drain tank means 54 which is connected with vertical drains 51 and horizontal drains 52 via water gathering pipes 53 (see also FIG. 6). The water gathering pipes 53 are laid above the first drain tank means 54 and send the water received from the horizontal drains 52 to the first drain tank means 54.

The vertical drains 51, the horizontal drains 52 and the water gathering pipes 53 are covered with airtight sheet means 50. This system functions similarly with the system introduced with reference to FIG. 1.

This system, however, additionally includes second water drain tank means 55 (see FIG. 7) to expel water out of the soft soil A, which is connected with the first tank means 54 via pipe means 56.

Figure 6:
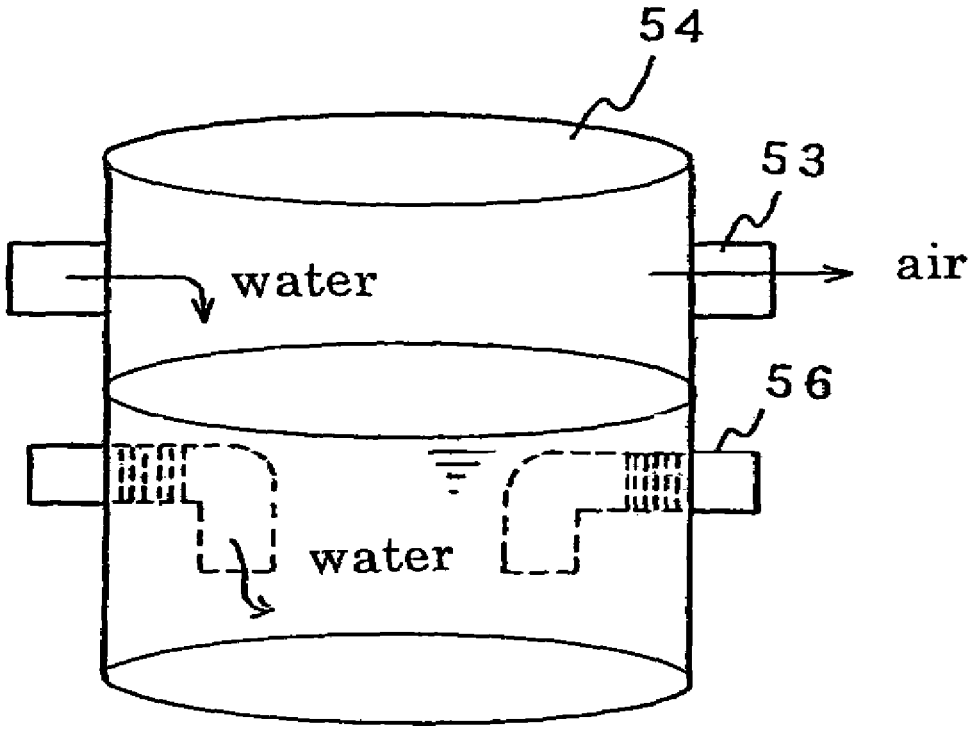
FIG. 6 is a schematic diagram showing a first drain tank of the drain system of FIG. 5.
Figure 7:
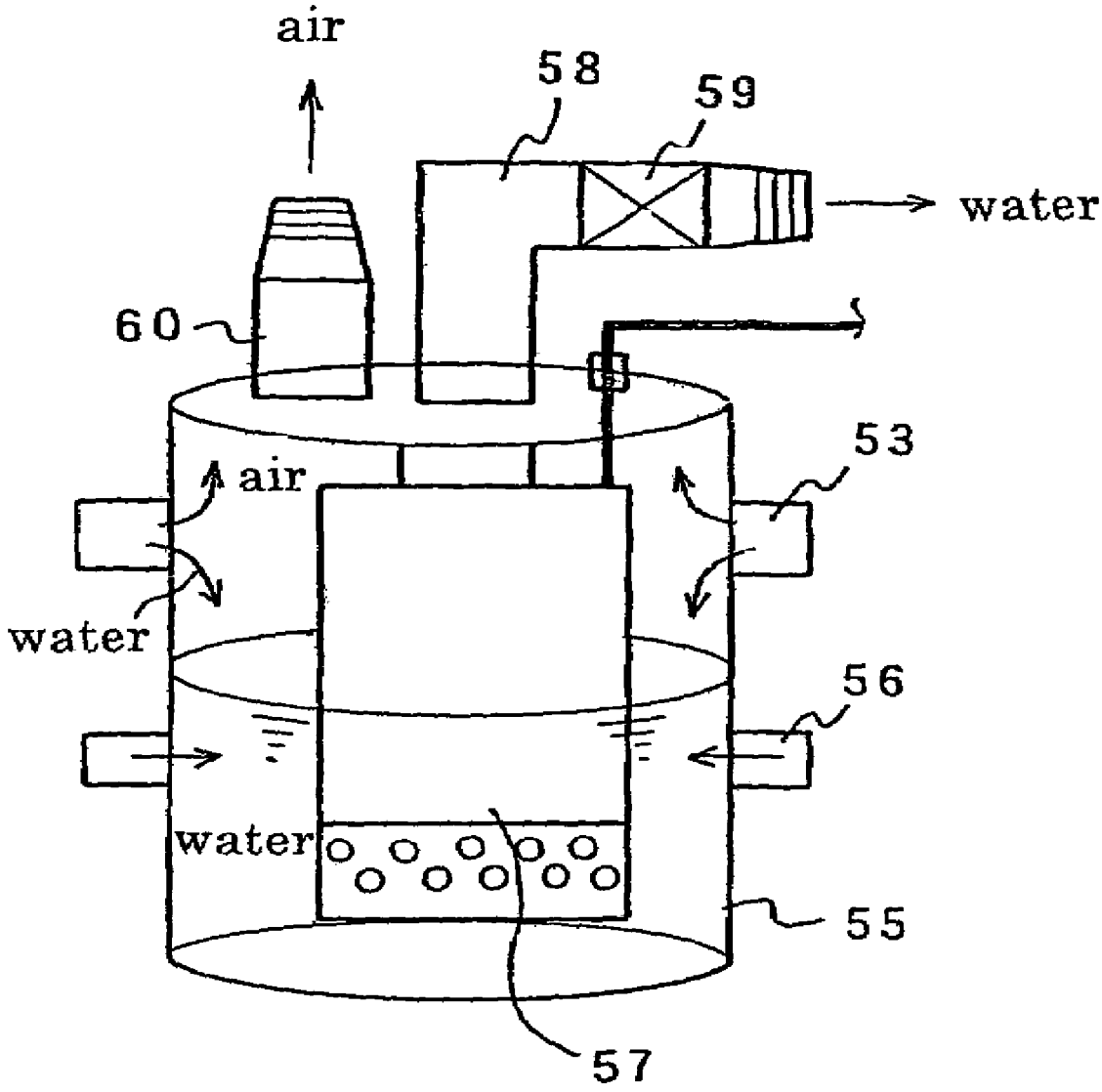
FIG. 7 is a schematic diagram showing a second drain tank of the drain system of FIG. 5.

The underground water drained into the first drain tank 54 is sent to the second drain tank 55 and expelled therefrom through a drain pipe 58 with a drain pump 57 provided within the second drain tank 55 as shown in FIGS. 6 and 7. The drain pipe 58 is provided with a check valve 59 to prevent counter water flow.

The air drawn into the second drain tank 55 together with water from the water gathering pipe 13 is expelled through an exhaust pipe 60 which is connected to the vacuum tank 14.

Figure 8:
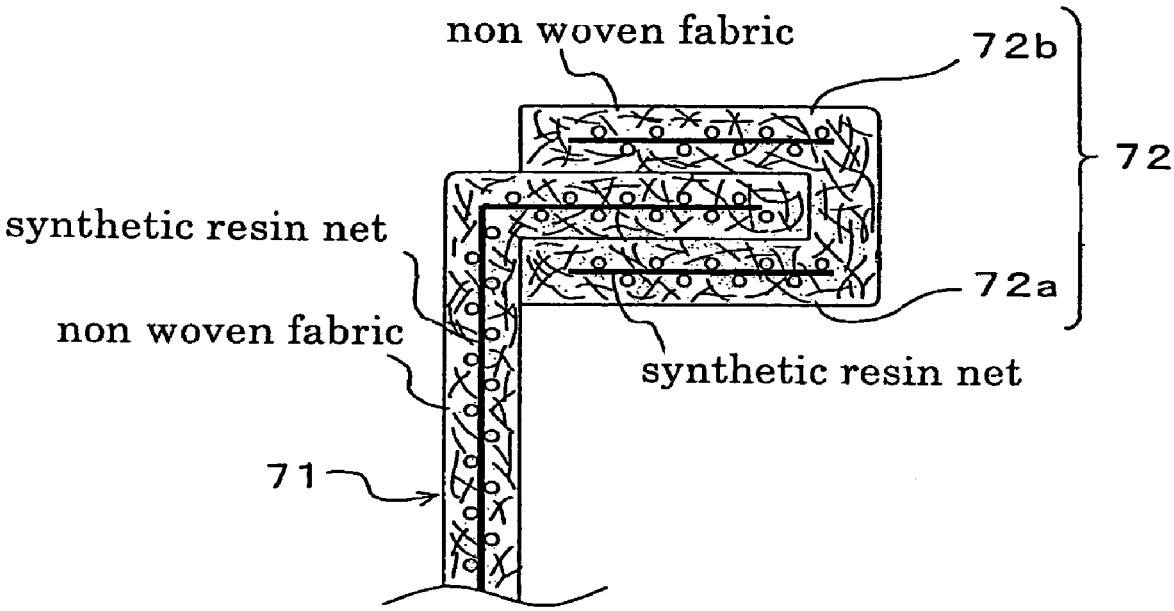
FIG. 8 is a schematic diagram partially showing a connection of a vertical drain and a horizontal drain of the present invention.
Figure 9:
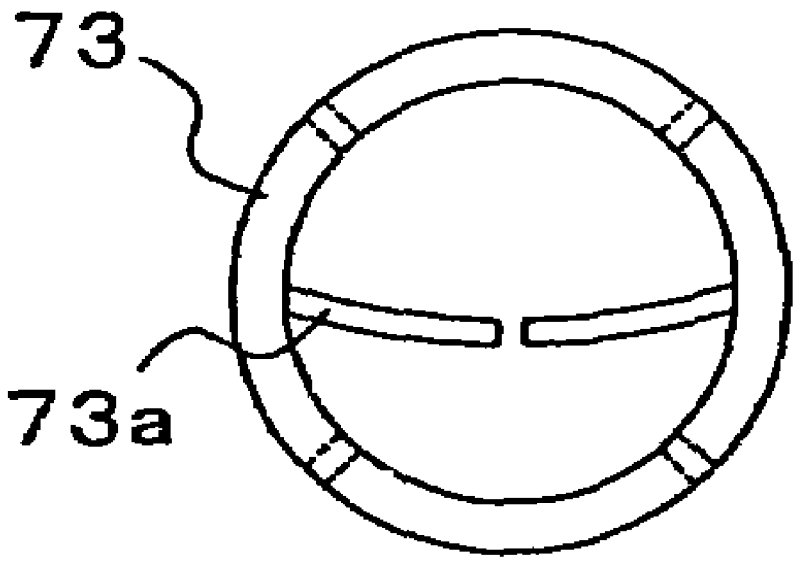
FIG. 9 is a schematic diagram showing a sectional view of a water gathering pipe of the present invention.
Figure 10:
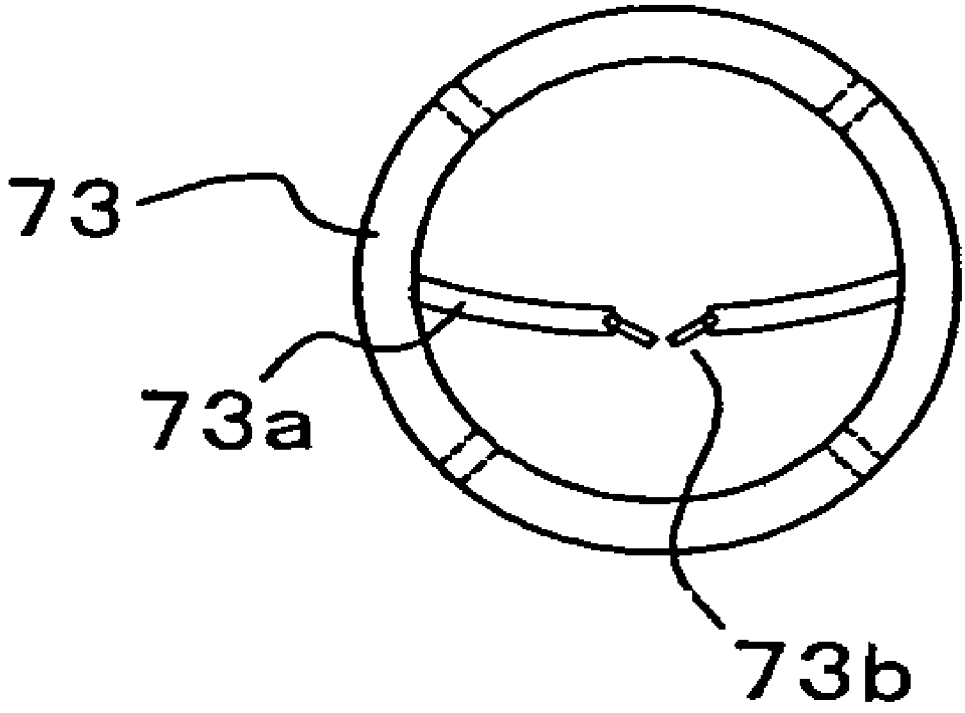
FIG. 10 is a schematic diagram showing a sectional view of another water gathering pipe of the present invention.
Figure 11:
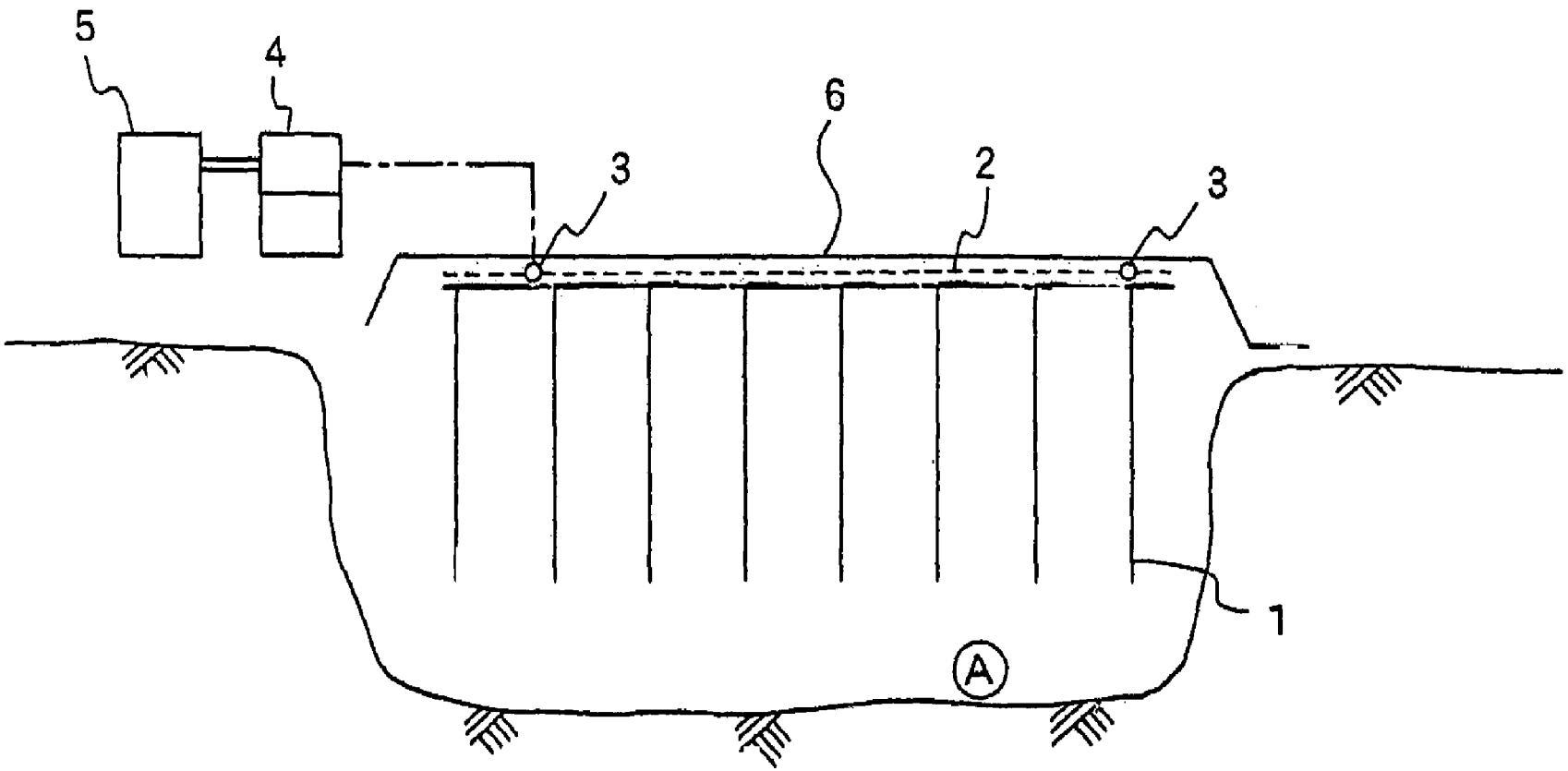
FIG. 11 is a schematic diagram showing a conventional drain system.

FIG. 8 shows a contact portion between the vertical drain 71 and the horizontal drain 72. FIG. 9 shows a water gathering pipe 73. FIG. 10 shows a modification to the water gathering pipe 73 of FIG. 9.

The horizontal drains 72 and water gathering pipes 73 provide air passages and water passages separately. The horizontal drain 72 which is comprised of two elongated net bodies which are sandwiched by an elongated nonwoven fabric body sandwiches a bent top portion of the vertical drain 71 between the upper portion 72*b* and the lower portion 72*a* of the horizontal drain 72 as shown in FIG. 8. The upper portion 72*b* provides the air passage and the lower portion 72*a* provides the water passage as the "heavier" underground water coming from the vertical drain 71 runs through the lower portion 72*a* and the "lighter" air coming from the vertical drain 71 runs through the upper portion 72*b*.

The water gathering pipe 73 also provides an air passage and a water passage separately. The water gathering pipe 73 shown in FIG. 9 is provided with many through holes in the cylindrical wall. An elongated inner partition 73*a* having a slit or slits axially divides the inside of the water gathering pipe 73 to provide the air passage above and the water passage below. In the modified water gathering pipe 73 shown in FIG. 10, the slit in the partition 73*a* of the water gathering pipe 73 is provided with check valve means 73*b* to prevent the water running in the water passage below from entering the air passage above.

The horizontal drain 72 and the water gathering pipe 73 of the present invention each having a water passage and a air passage separately provide efficient and quick drainage of the target soft soil A, an improvement over conventional systems.

In the following, a drainage method of the present invention is described using the drawings that accompany this specification. First, a method using the drain system of FIG. 1 is described. A plurality of vertical drains 11 are driven into a target soft soil A with mandrel means (not shown) at appropriate intervals, length and breadth. A preferred interval is about 1 m. The mandrel means are removed from the soft soil A after the vertical drains 11 have been installed in the soft soil A. The vertical drains 11 provide water drainage and air suction routes.

Next, a plurality of horizontal drains 12 are laid on the ground surface of the target soft soil A in contact with the upper end portions 11*a* of the vertical drains 11. A plurality of water gathering pipes 13 are then laid in contact with the horizontal drains 12. The water gathering pipes 13 are provided with through holes in their cylindrical walls to suck up water and air therethrough. The water gathering pipes 13 are connected to vacuum tank means 14 installed outside the target soil A, which is connected to vacuum pump means 15 installed outside the target soft soil A. The vacuum pump means 15 evacuates the vacuum tank means 14, the water gathering pipes 13, the horizontal drains 12 and the vertical drains 11 in this order to below 0.4 atm or so.

After having installed the vertical drains 11, the horizontal drains 12 and the water gathering pipes 13, airtight sheet means 10 is spread over the vertical drains 11, the horizontal drains 12 and the water gathering pipes 13 to promote vacuuming of the soft soil A.

Underground water and air are attracted into the vertical drains 11. The drawn water and air go up the vertical drains 11 and run into the horizontal drains 12 and then into the water gathering pipes 13.

As shown in FIG. 1, water drain tank means 16 is provided below the water gathering pipes 13. The water in the water gathering pipes 13 is drawn into the drain tank means 16 through separator means 17 which separates air from water.

The soft soil A is gradually compacted and sinks, widening the vertical distance between the vacuum pump means 14 and the water drain tank means 16. When the distance reaches about 10 meters, the pump means 14 loses its pumping function.

In order to pump up underground water continuously to the ground surface, the drain tank means 16 is internally provided with drain pump means 18. The drain pump means 18 pumps the water in the drain tank means 16 out of the soft soil A through connection pipes 19 and drain pipes 20.

The drain pump means 18 is thus capable of further hardening the soft soil A when continuously used after the vacuum pump means 14 cannot provide vacuuming effect any longer. It is to be noted that the drain tank means 16 may not require assistance of the drain pump means 14 depending on the target soil condition.

In the method using the devices shown in FIGS. 5–7, vertical drains 51, horizontal drains 52, water gathering pipes 53, first water drain tank means 54 and second water drain tank means 55 are used. The first water drain tank means 54 and the second water drain tank means 55 are connected by connection pipes 56. The water gathered in the water gathering pipes 13 is drained into the first water drain tank means 54, then into the second water drain tank means 55. The water gathered in the second water drain tank means 55 is pumped with drain pump means 57 out of the target soil A.

In the method using the devices shown in FIGS. 8 to 10, both the horizontal drains 72 and the water gathering pipes 73 have separate air passages and water passages, capable of efficiently draining underground water. Vacuuming processes may be controlled in accordance with requirements and given conditions of target soil A.

INDUSTRIAL UTILIZATION OF THE INVENTION

The present invention is capable of efficiently draining and hardening soft soil by using a drain system having separated water routes and air routes. The efficiency is improved by use of water drain tank means having water drain pump means, which provides continuous drainage and hardening of soft soil after vacuum pump means can no longer provides its expected function.

What is claimed is:

1. A system for reforming soft soil, comprising substantially vertical drains installed within the soft soil for vacuuming the soft soil and draining underground water thereby, the drains in communication with independent water gathering means in communication with and positioned above water drain tank means installed within the soft soil to gravitationally separate water and air by allowing water to drop into the water drain tank means, whereby the water in the water drain tank means is forcedly drained out of the soft soil.

2. A system according to claim 1, wherein the water gathering means comprises substantially horizontal water gathering pipes.

3. A system according to claim 2, further comprising horizontal drains laid on the target soft soil in contact with top portions of the vertical drains, and further wherein the water gathering pipes communicate with the horizontal drains, and the water gathering pipes and the water drain tank means each provide a water passage and an air passage separately.

4. A system according to claim 1, further comprising separately provided water expelling routes and air expelling routes.

5. A system according to claim 1, wherein the water gathering means and the water drain tank means are connected via separator means.

6. A system according to claim 1, wherein said water drain tank means is provided with water drain pump means.

7. A system according to claim 1, further comprising watertight type vacuum pump means having cooling water circulation tank means.

8. A system according to claim 1, further comprising vertical pipes installed proximate the target soft soil to evaporate underground water therefrom.

9. A drain system according to claim 8, wherein the vertical pipes are provided with air blower means.

10. A drain system according to claim 8, further comprising first water drain tank means in communication with the water gathering means and second water drain tank means in communication with the first water drain tank means whereby water is received into the second water drain tank means from the first water drain tank means via connection pipes, wherein the second water drain tank means is provided with water drain pump means for expelling water from said second water drain tank means.

11. A system for reforming soft soil, wherein the soft soil is covered with air-tight sheet means for effectively vacuuming the soft soil thereunder to produce a pressure reduced environment in the soft soil in isolation from areas bordering the soft soil, comprising:

(a) substantially vertical drains;
(b) substantially horizontal drains installed in association with the vertical drains;
(c) water gathering pipes installed in association with the horizontal drains;
(d) first water drain tanks installed within the soft soil and in association with the water gathering pipes; and
(e) at least one second water drain tank with drain pump means installed in association with the first water drain tanks and the soft soil bordering areas, wherein the first water drain tanks are interconnected with each other via connection pipes and the first water drain tanks and the second water drain tank are connected via connection pipes, wherein the water in the water gathering pipes is drained into the first water drain tanks, wherein water and air in the first water drain tanks is separated and the water is drained into the second water drain tank through the connecting pipes, and wherein the water in the second water drain tank is forcedly drained out of the soft soil with the drain pump means.

12. A system according to claim 11, wherein the water gathering pipes are positioned above the first water drain tanks, whereby water and air in the gathering pipes are gravitationally separated by allowing only the water to drop from the gathering pipes into the first water drain tanks.

13. A method for reforming soft soil, comprising providing vertical drain routes within the soft soil, vacuuming the soft soil via the vertical drain routes to drain underground water within the soft soil, providing independent water drainage routes including water drain tank means installed within the soft soil which gravitationally separates water and air, and forcedly draining the water in the water drain tank means out of the soft soil.

14. A method according to claim 13, further comprising separating water expelling routes and air expelling routes.

15. A method according to claim 13, further comprising installing the water drain tank means under water gathering pipes in fluid connection with horizontal drains and vertical drains so as to receive underground water from the water gathering pipes.

16. A method of claim 13, further comprising providing separator means which separates underground water coming from the water gathering pipes into water and air and sends the separated water into the water drain tank means.

17. A method of claim 13, further comprising providing water drain pump means to expel the water in the water drain tank means out of the target soft soil.

18. A method according to claim 13, further comprising providing first water drain tank means in connection with water gathering pipes, providing second water drain tank means in connection with the first water drain tank means whereby the water is received into the second water drain tank means from the first water drain tank means via connection pipes, providing the second water drain tank means with water drain pump means, and expelling water from the second water drain tank means with the water drain pump means.

19. A method for reforming soft soil, wherein the soft soil is covered with air-tight sheet means for effectively vacuuming the soft soil thereunder to produce a pressure reduced environment in the soft soil in isolation from areas bordering the soft soil, comprising:

(a) providing independent water drainage routes including first water drain tank means installed within the soft soil which separates water and air, and forcedly draining the water in the water drain tank means out of the soft soil
(b) installing substantially vertical drains;
(c) installing substantially horizontal drains in association with the vertical drains;
(d) installing water gathering pipes in association with the horizontal drains;
(e) installing the first water drain tanks in association with the water gathering pipes;
(f) installing at least one second water drain tank with drain pump means in association with the first water drain tanks and the soft soil bordering areas;
(g) interconnecting the first water drain tanks via connection pipes;
(h) connecting the first water drain tanks and the second water drain tank via connection pipes;
(i) draining the water in the water gathering pipes into the first water drain tanks;
(j) draining the water in the first water drain tanks into the second water drain tank through the connecting pipes; and
(k) forcedly draining the water in the second water drain tank out of the soft soil with the drain pump means.

20. A system according to claim 18, further comprising the step of installing the water gathering pipes above the first water drain tanks, and further wherein the step of draining water in the water gathering pipes into the first water drain tanks comprises allowing the water to drop from the gathering pipes into the first water drain tanks, whereby water and air in the gathering pipes are gravitationally separated.

* * * * *